US005248951A

United States Patent [19]

Sogabe et al.

[11] Patent Number: 5,248,951

[45] Date of Patent: Sep. 28, 1993

[54] REMOTE CONTROLLED RELAY

[75] Inventors: Manabu Sogabe; Hiroaki Fujihisa; Shuji Matsumoto, all of Fukuyama, Japan

[73] Assignee: Mitsubishi Denki Kabushiki Kaisha, Tokyo, Japan

[21] Appl. No.: 820,234

[22] Filed: Jan. 14, 1992

[51] Int. Cl.[5] ..... H01H 83/00

[52] U.S. Cl. ..... 335/14; 335/20

[58] Field of Search ..... 335/14, 20, 6, 202

[56] References Cited

U.S. PATENT DOCUMENTS

Re. 32,882 3/1989 Yokoyama et al. ..... 335/14
4,725,799 2/1988 Bratkowski et al. .
4,743,877 5/1988 Oberndorfer et al. ..... 335/128

FOREIGN PATENT DOCUMENTS 0458294 11/1991 European Pat. Off. .
2173642 10/1986 United Kingdom .

*Primary Examiner*—Lincoln Donovan
*Attorney, Agent, or Firm*—Burns, Doane, Swecker & Mathis

[57] ABSTRACT

In a remote controlled relay having a manual operation handle coupled to a plunger of an electromagnetic device, a relatively large clearance in a coupling part allows for free movement of the plunger without any interference except a friction force thereof even when the operation handle is stopped at a deadlock point between an ON position and an OFF position.

2 Claims, 7 Drawing Sheets

REMOTE CONTROLLED RELAY

BACKGROUND OF THE INVENTION

1. FIELD OF THE INVENTION

The present invention relates to an improvement of a remote controlled relay.

2. DESCRIPTION OF THE RELATED ART

The same inventors have proposed a remote controlled relay shown in FIGS. 3 to 9 in a prior application, filed on Nov. 27, 1991 in the U.S. (application Ser. No. 07/799,124). FIG. 3 is a cross-sectional side view showing the related remote controlled relay when the relay is switched off (hereinafter abbreviated as OFF). FIG. 4 is a plan view of the related remote controlled relay shown in FIG. 3. FIG. 5 is a cross-sectional side view of the related remote controlled relay when the relay is switched on (hereinafter abbreviated as ON). FIG. 6 is a plan view of the related remote controlled relay shown in FIG. 5. FIG. 7 is a cross-sectional side view showing main parts of the related remote controlled relay in a condition shown in FIG. 3. FIG. 8 is a cross-sectional side view showing the main parts of the related remote controlled relay in the condition shown in FIG. 5. FIG. 9 is a circuit diagram showing a circuit of the typical remote controlled relay.

In the figures, a housing 1 consists of a base member 1A and a cover member 1B. The housing 1 has: a pair of grooves **1*a* formed on side walls 1*e* and 1*f* in the vicinity of a bottom face 1*g*, whereto fixing bands (not shown in the figure) are to be coupled; a pair of protrusions 1*b* in the vicinity of the center part of the bottom face 1*g*, whereby the housing 1 is to be fixed on a DIN standard rails (not shown in the figure); and an opening 1*c* on its top face 1*h*. The base member 1A and the cover member 1B respectively have four coupling holes 1*d* and four protrusions (not shown in the figure). Each hole 1*d* on the base member 1A are provided to face and to couple each hole formed on the protrusion of the cover member 1B. The base member 1A and the cover member 1B are connected and fixed by rivets 2 which are fit in the holes 1*d***.

As shown in FIG. 3 or 5, a driving magnet 3 is positioned substantially in the center of the housing 1, wherein the driving magnet 3 is provided in a manner that the moving direction of the plunger 4 is perpendicular to the bottom face **1*g* of the housing 1. The driving magnet 3 is a polarized-type, and the plunger 4 is slidably provided on a center hole of a bobbin 6 as shown in FIGS. 7 and 8, whereon an electromagnetic coil 5 is wound. The plunger 4 has upper and lower armatures 4*a*, 4*b* on both ends. A first yoke 7 encloses the bobbin 6 and has an opening 7*a* from which a rod part 4*c* of the plunger 4** projects upwards.

Permanent magnets 8 are provided on inner walls of the first yoke 7, for example, at right and left hands in the figures, and both permanent magnets 8 are fixed on the first yoke 7 in a manner that one face of the poles of the magnets 8 contact to the inner face of the first yoke 7. The other faces of the magnets 8 having the other polarity are fixed to second yokes 9 which have a channel-section. The second yokes 9 are provided in a manner that brim parts the bobbin 6 of the coil 5 are fit in the channel-section parts of the second yokes 9.

A link 11 for transmitting the movement of the plunger 4 to a moving contact 10 is provided above the driving magnet 3. The link 11 is rotatably pivoted on the housing 1 by a pin 12. An end **11*a* of the link 11 is pin-joined to an end of the rod part 4*c* of the plunger 4 by a connecting pin 13**.

A moving unit 14 comprises: an insulating member 16 which is pin-jointed to an end thereof to the other end **11*b* of the link 11 by a pin 15; a moving base member 17 which is slidably fit in a guide groove 16*a* formed on the other end of the insulating member 16 and whereto the moving contact 10 is fixed; and a compression spring 18 for supplying a pressure to the moving contact 10. The moving contact 10 faces a fixed contact 20 which is fixed on a main terminal 19 whereto a main circuit is connected in a manner that the moving contact 10 is driven toward and away from the fixed contact 20 by movement of the moving unit 14**.

Rod-shaped protrusions **16*b* formed on both sides (forward and backward of FIG. 5) of the insulating member 16 are slidably engaged in grooves (not shown) of the base member 1A and the cover member 1B. Thereby, the moving unit 14 is driven by the movement of the plunger 4 in a manner that the moving contact 10 moves toward and away from the fixed contact 20. The moving base member 17 is electrically connected to another main terminal 22, whereto the main circuit is connected, by the shunt 21**.

A pair of remote control terminals 23 are provided on an upper part of the side **1*e* of the housing 1 whereto wires of a remote controller are connected. One of the remote control terminals 23 is connected to a lead wire 5*a* of the electromagnetic coil 5 and the other remote control terminal 23 is connected to the other lead wire 5*b* of the coil 5 via diodes 24 and a switch 25 on a printed circuit substrate 26. The circuit diagram of the typical remote controlled relay is shown in FIG. 9**.

An operation handle 27 is rotatably pivoted on the housing 1 by a pin 28 on a point opposite to the link 11 against the plunger 4. The operation handle 27 is coupled to the rod part **4*c* of the plunger 4 by a coupling pin 13, wherein an end of the coupling pin 13 is press-fit in a coupling hole 29. Thereby, the operation handle 27 is rotated by reciprocating movement of the plunger 4 in directions opposite to the rotation directions of the link 11. The operation handle 27 has a knob 27*a* which is manually operated from the outside of the housing 1. The knob 27*a* is positioned in the opening 1*c* of the housing 1 (consisting of the base member 1A and the cover member 1B). On parts of the surface of the operation handle 27 which are positioned symmetrical to the knob 27*a*, indications 27*b* (shown in FIGS. 4 and 6) for indicating the ON state and OFF state of the relay are provided. The indications 27*b* are observed through the opening 1*c*. Furthermore, the operation handle 27 has an operation part 27*c* which contacts an actuator 25*a* of the switch 25 for switching the switch 25**.

Next, operation of the above-mentioned related remote controlled relay is described.

FIG. 3 shows the OFF state when the remote controlled relay is switched off. At this time, the plunger 4 is held in a manner that the armature **4*a* is attracted to the bottom face of the first yoke 7 by the magnetic flux of the permanent magnet 8, and the moving contact 10 and the fixed contact 20 are respectively at stable positions wherein the contacts 10 and 20** are apart from each other.

In such a state when the main circuit is opened, the electromagnetic coil 5 is excited by switching on a remote control switch 30 (shown in FIG. 9) which is connected to the remote control terminals 23, the magnetic flux produced reduces the magnetic attraction force of the permanent magnets 8 on the armature 4*a* of the plunger 4 and increases the magnetic attraction force of the coil 5 on the other armature 4*b* of the plunger 4. Thereby, the plunger 4 is driven in a direction shown the arrow in FIG. 7, the link 11 is rotated a counterclockwise direction, the moving contact 10 is moved to the fixed contact 20 and finally the main circuit is closed by the contacting of the moving contact 10 and the fixed contact 20. In this state, the armature 4*b* of the plunger 4 is attracted and held on an upper inner face of the first yoke 7. At this time, the operation handle 27 is rotated in a clockwise direction by the movement of the plunger 4 and the indication is changed from OFF to ON. In such a sequence of operations, the operation handle 27 drives the actuator 25*a* of the switch 25 and thereby the switch 25 is turned on or off.

When the main circuit is turned on, the remote control switch 30 shown in FIG. 9 is switched on, the electromagnetic coil 5 is excited to produce magnetic flux for reducing the magnetic attraction force of the permanent magnets 8 on the armature 4*b* of the plunger 4 and for increasing the magnetic attraction force of the coil 5 on the other armature 4*a* of the plunger 4. Thereby, the plunger 4 is driven in a direction shown by the arrow in a FIG. 8, the link 11 is rotated in clockwise direction, the moving contact 10 is moved away from the fixed contact 20, and finally the main circuit is opened by moving the moving contact 10 from the fixed contact 20. In this state, the armature 4*a* of the plunger 4 is attracted to the bottom face of the first yoke 7, that is the initial stable state. At this time, the operation handle 27 is rotated in a counterclockwise direction by the movement of the plunger 4 and the indication is changed from ON to OFF. In such a series of the operation, the operation handle 27 drives the actuator 25*a* of the switch 25, and thereby the switch 25 is turned off.

For manually switching on and off the main contacts from outside of the housing 1, the knob 27*a* of the operation handle 27 is driven by hand, and the plunger 4 is directly driven, thereby switching the contacts on and off. In manual operation, a removing force, larger than the attraction force of the permanent magnet for attracting the plunger 4 on the first yoke 7, is directly applied on the plunger 4 by hand, and thereby the plunger 4 is forcibly moved and shifted to the other stable state. During manual operation, the movement of the moving unit 14 and the switching operation of the switch 25 are the same as the aforementioned remote control.

In the above-mentioned related remote controlled relay, the coupling pin 13 is tightly fit in the coupling hole 29 of the operation handle 27, and hence the operation handle 27 and the plunger 4 are uncooperatively pin-jointed by the coupling pin 13. When the operation handle 27 is erroneously stopped at a neutral position (an intermediate position between the OFF position shown in FIG. 7 and the ON position shown in FIG. 8), both of the armatures 4*a* and 4*b* of the plunger 4 are not attracted to the first yoke 7. Namely, the plunger 4 is deadlocked at a neutral position of the driving magnet 3.

OBJECT AND SUMMARY OF THE INVENTION

The purpose of the present invention is to solve the above-mentioned problems and to provide an improved remote controlled relay wherein the plunger 4 is not deadlocked at a neutral position of the driving magnet 3 even when the operation handle 27 is stopped at a neutral position.

A remote controlled relay in accordance with the present invention comprises:

a fixed contact which is connected to a main circuit;

a moving contact which is connected to the main circuit;

a housing having a base member and a cover member;

a polarized electromagnetic device fixed to a center part of the housing;

a plunger which is reciprocally driven in a direction vertical to a fixing face of the electromagnetic device and the housing, by magnetic flux produced by the electromagnetic device;

an operation handle pivoted on the housing, pin-jointed to the plunger at an end thereof by coupling of a coupling pin of the plunger in a coupling hole of the operation handle, and linked by contacting at the other end to a switch connected to a remote control circuit, the clearance between the coupling hole and the coupling pin being sufficiently larger to allow the movement of the plunger; and a link pivoted on the housing, pin-jointed to the plunger at an end thereof by the coupling pin and coupled to a moving part at the other end thereof.

In the remote controlled relay configured above, a sufficient clearance is provided between the connecting hole of the operation handle and the connecting pin which constitute a coupler of the operation handle and the plunger. Therefore, the plunger can be moved without any interference except a friction force thereof and especially can be moved from a deadlock point even when the operation handle is stopped at a deadlock point between the ON position and OFF position.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 5 is a cross-sectional side view of the related remote controlled relay when the relay is switched on.

It will be recognized that some or all of the Figures are schematic representations for purposes of illustration and do not necessarily depict the actual relative sizes or locations of the elements shown.

DETAILED DESCRIPTION OF THE PREFERRED EMBODIMENTS

Figure 1:
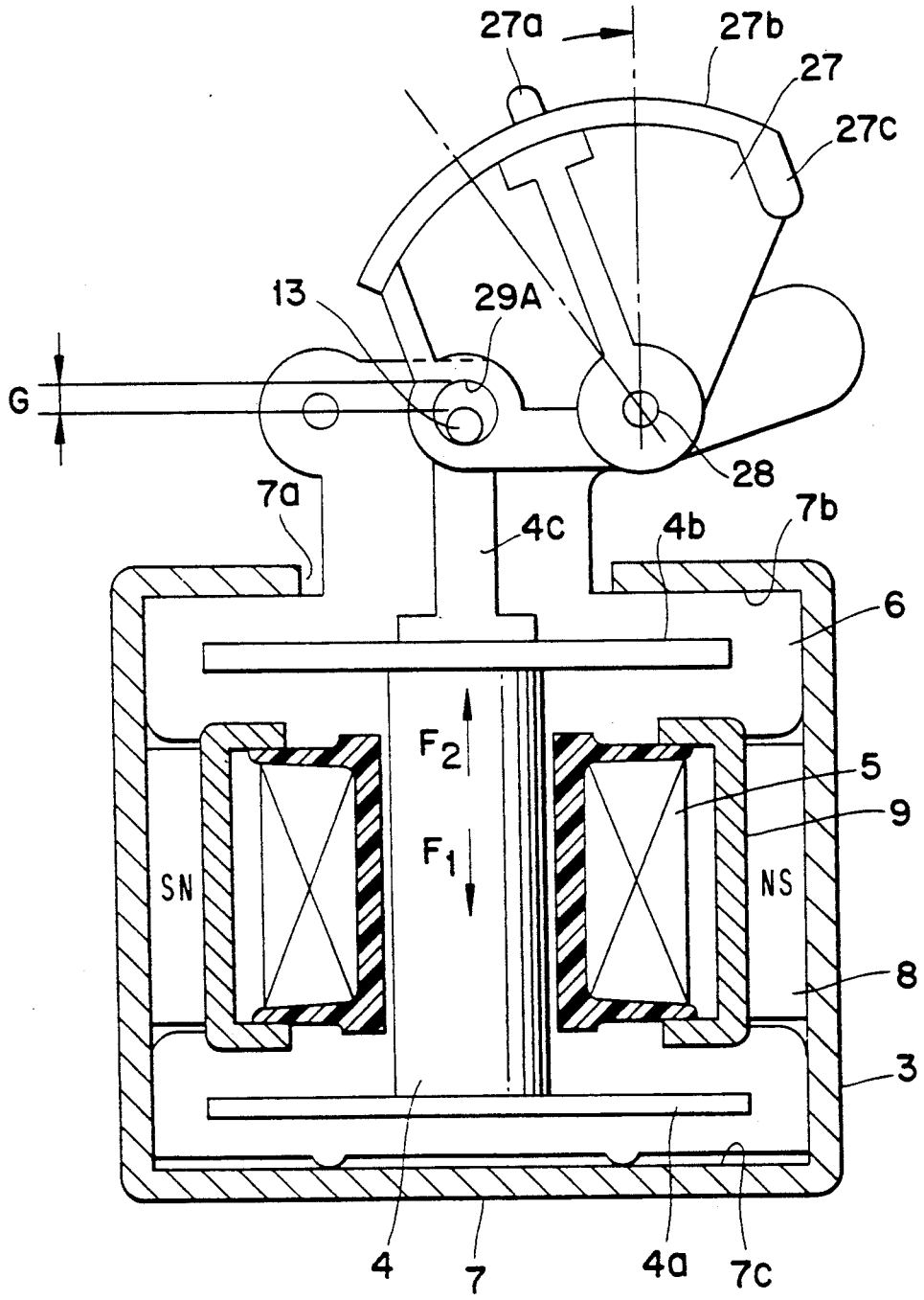
FIG. 1 is a cross-sectional side view showing a main driving unit of a remote controlled relay in accordance with the present invention.
Figure 2:
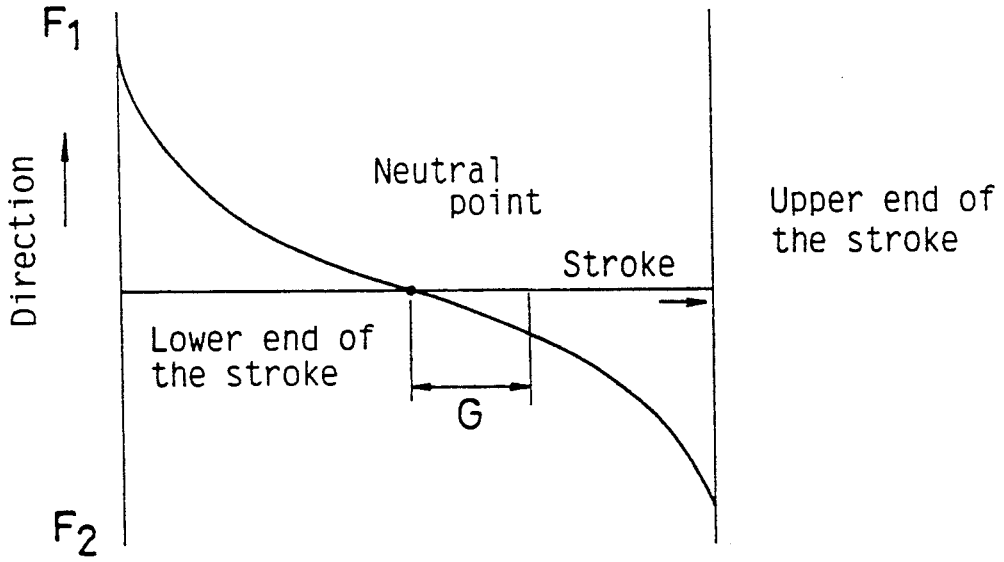
FIG. 2 is a drawing showing a characteristic curve of a relation between a clearance of a coupler of an operation handle and a plunger and a stroke of the plunger.
Figure 3:
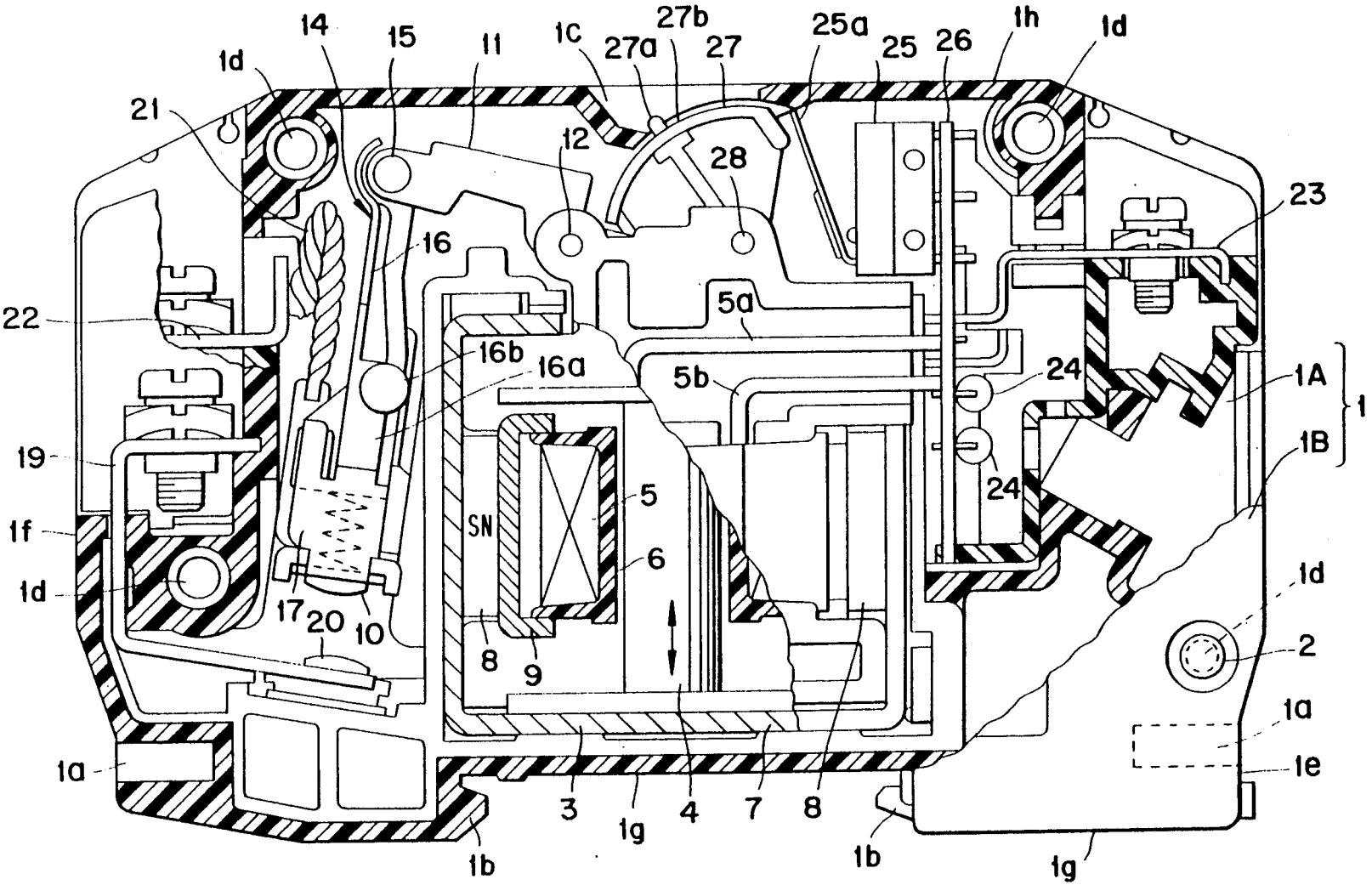
FIG. 3 is a cross-sectional side view showing a constitution of the related remote controlled relay when the relay is switched off.
Figure 4:
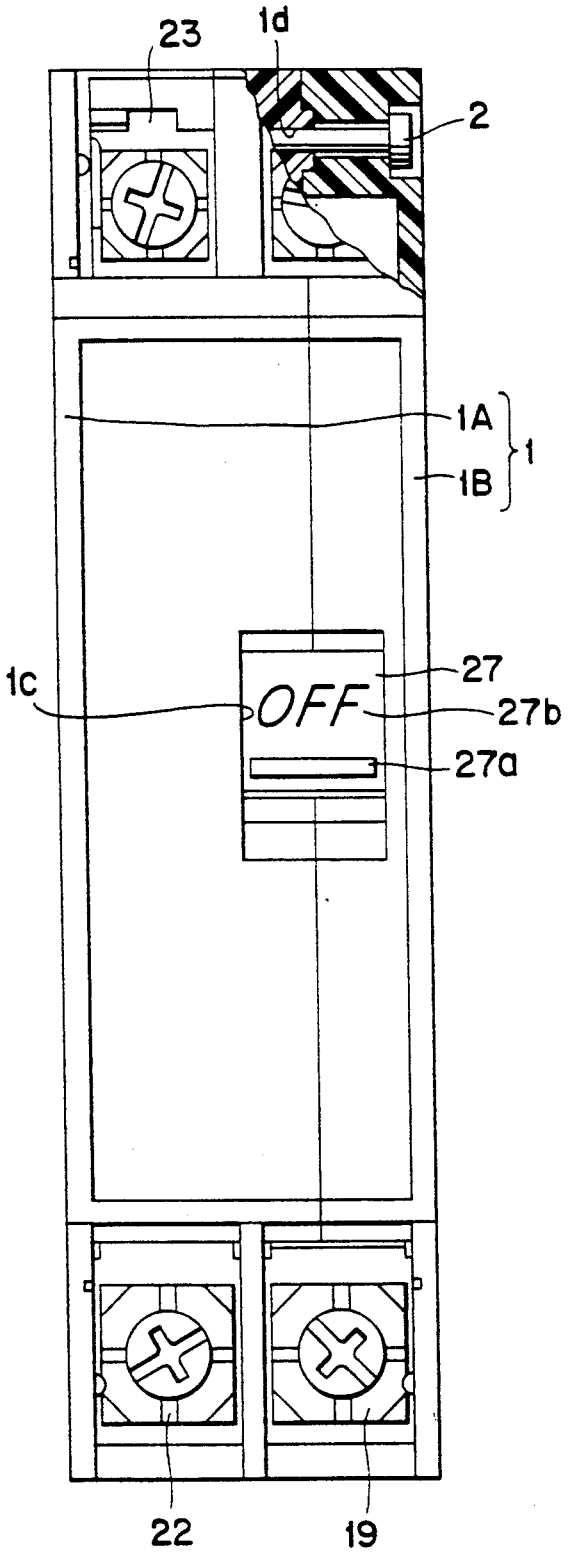
FIG. 4 is a plan view of the related remote controlled relay shown in FIG. 3.
Figure 6:
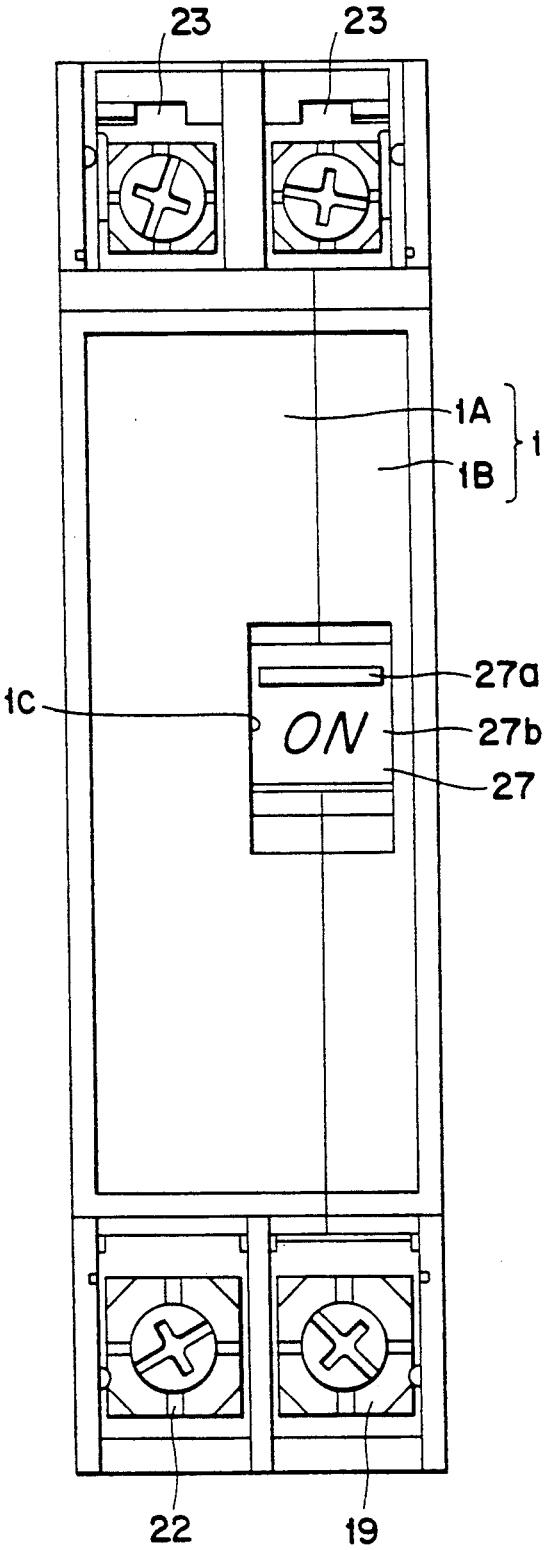
FIG. 6 is a plan view of the related remote controlled relay shown in FIG. 5.
Figure 5:
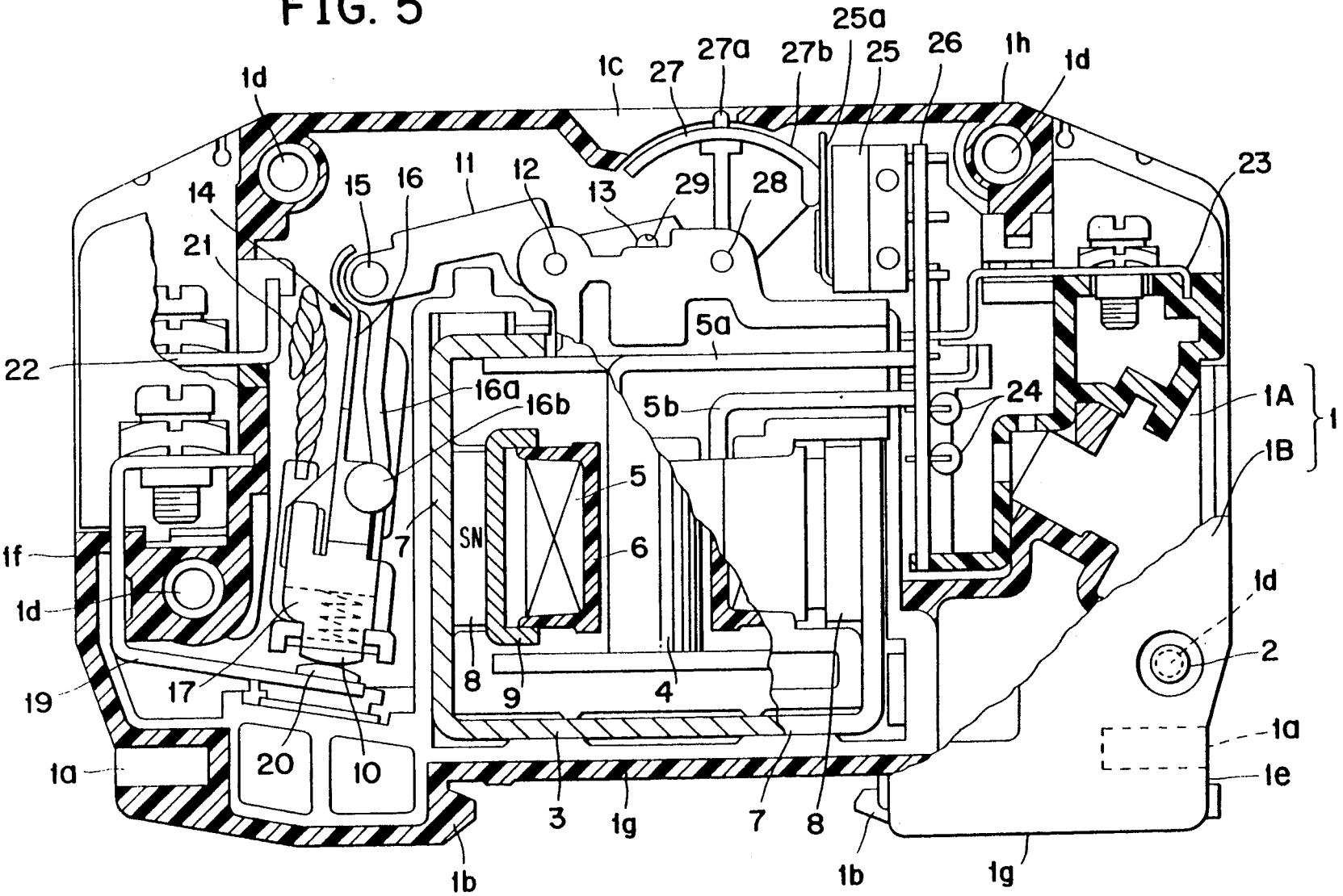
Figure 7:
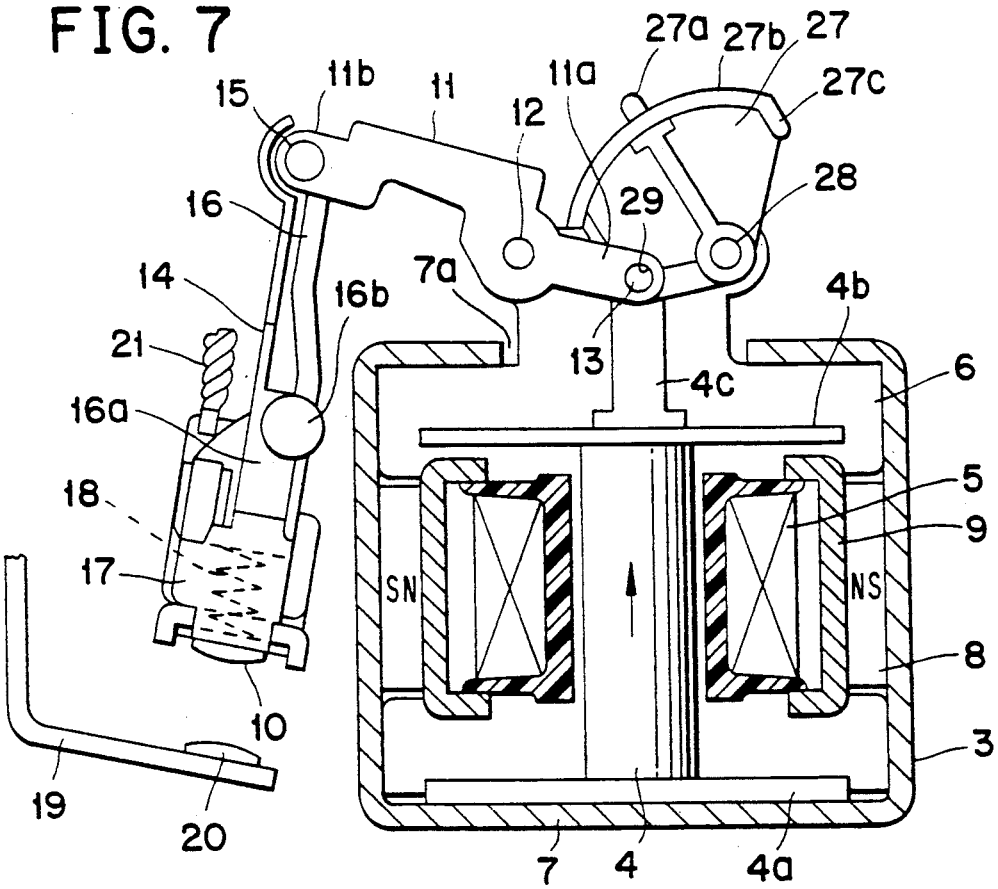
FIG. 7 is a cross-sectional side view showing main parts of the related remote controlled relay in a condition shown in FIG. 3.
Figure 8:
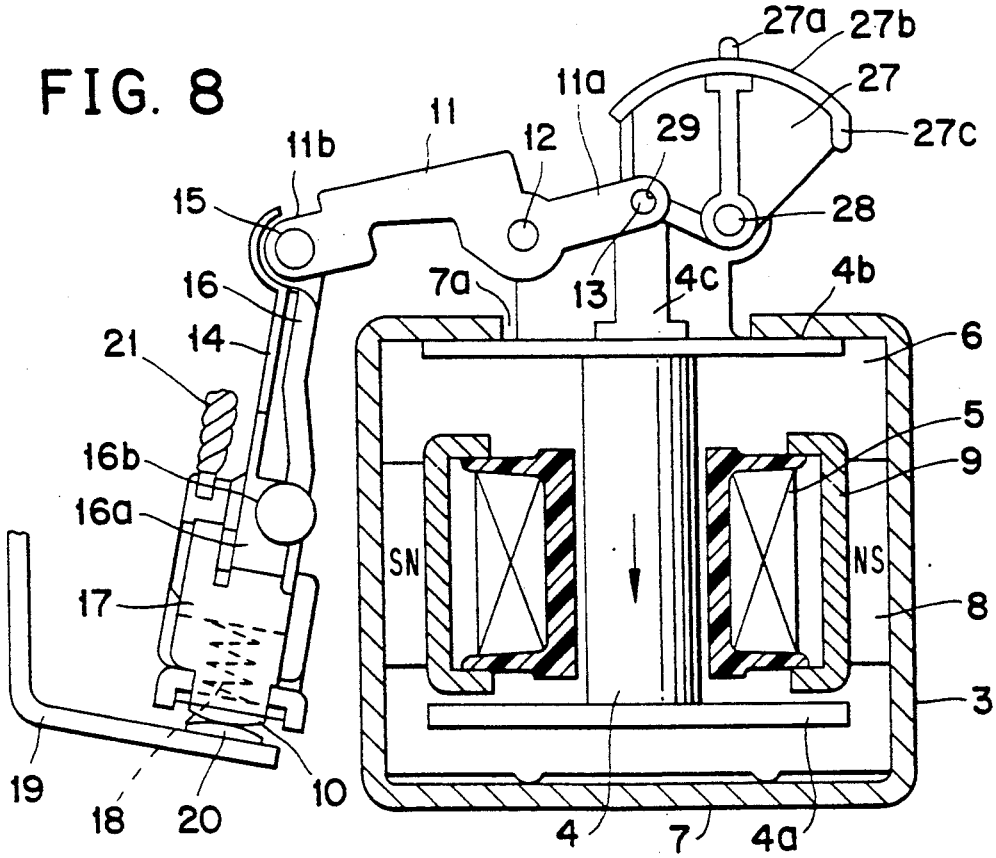
FIG. 8 is a cross-sectional side view showing the main parts of the related remote controlled relay in a condition shown in FIG. 5.
Figure 9:
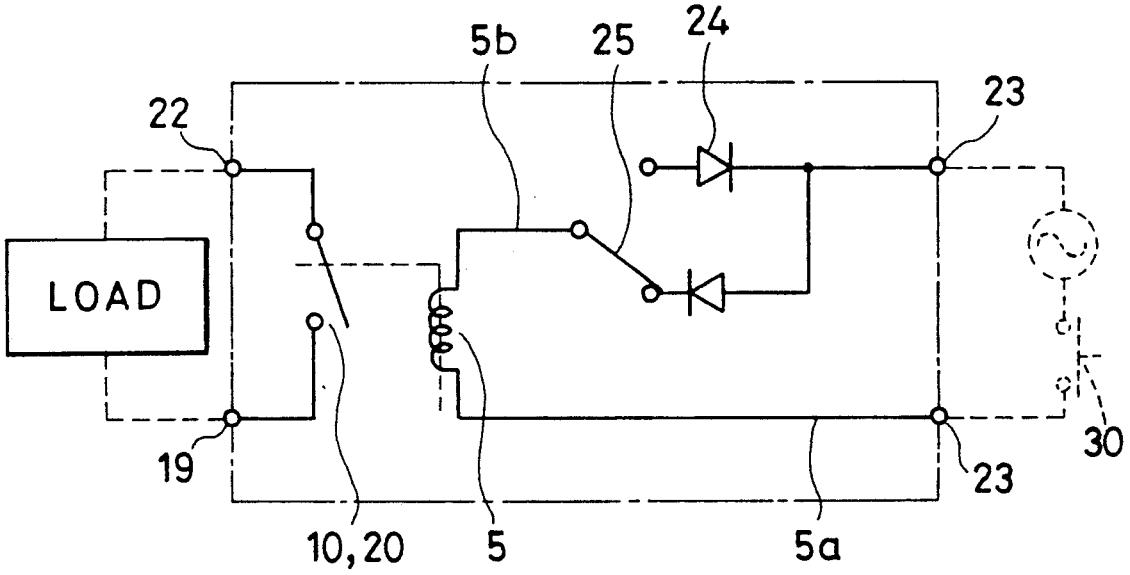
FIG. 9 (Prior Art)
FIG. 9 is a circuit diagram showing a circuit of the typical remote controlled relay.

A preferred embodiment of a remote controlled relay in accordance with the present invention is described referring to FIGS. 1 and 2. FIG. 1 is a cross-sectional side view showing a main driving unit of a remote controlled relay in accordance with the present invention. FIG. 2 is a drawing of a characteristic curve showing a relation of a clearance between a coupler of an operation handle and a plunger and a stroke of the plunger. The components constituting the remote controlled relay in accordance with the present invention are substantially the same as those of the afore-mentioned related art remote controlled relay, and hence the description of them are omitted.

In FIG. 1, a coupling hole 29A is provided on an operation handle 27. The diameter of the coupling hole 29A is selected larger than a coupling pin 13. When a plunger 4 is coupled to the operation handle 27 by the coupling pin 13, there is a clearance shown by G in FIG. 1. By such a clearance, the plunger 4 can be moved without any interference except a friction force thereof in the clearance shown by G. Therefore, even when the operation handle 27 is stopped at a neutral point as shown in FIG. 2, the plunger 4 can be moved upward by coasting after the plunger 4 has started to move upward as shown by arrow $F_2$ in FIG. 1. An upper armature 4*b* of the plunger 4 is attracted to and held on an upper face 7*b* of a first yoke 7. At this time, the remote controlled relay in accordance with the present invention is at ON state. Similarly, during downward movement of the plunger 4 as shown by arrow $F_1$ in FIG. 1, the plunger 4 can be moved downward by coasting, and a lower armature 4*a* is attracted to and held on a lower face 7*c* of the first yoke 7. At this time, the remote controlled relay is at OFF state.

A relation between a stroke of the plunger 4 and the clearance G is shown in FIG. 2, wherein the ordinate is graduated by the electromagnetic force to drive the plunger 4 and the abscissa is graduated by stroke of the plunger 4. In FIG. 2, $F_1$ and $F_2$ designate the direction of the movement of the plunger 4 shown in FIG. 1. By providing a large clearance between the inner wall of the hole 29A and the surface of the coupling pin 13, in the vicinity of the neutral point of the stroke of the plunger 4, the plunger 4 has a large coasting force, and thereby the plunger 4 barely stops at a point in the vicinity of the neutral point.

As mentioned above, even when the operation handle 27 is stopped at a neutral point, the plunger 4 can move. Thereby, the remote controlled relay in accordance with the present invention minimizes the possibility of a deadlock state.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications that fall within the true spirit and scope of the invention.

What is claimed is:

1. A remote controlled relay comprising:

a fixed contact for connection to a main circuit;

a movable contact for connection to said main circuit;

a housing;

an electromagnetic device fixed to a center part of said housing for producing magnetic flux;

a plunger reciprocally driven by said magnetic flux in a direction vertical to a fixing face of said electromagnetic device and said housing;

an operation handle pivoted on said housing, pin-jointed to said plunger at a first end by coupling a coupling pin of said plunger in a coupling hole of said operation handle, and linked by contacting at a second end a switch connected to a remote control circuit, a clearance between said coupling hole and said coupling pin being sufficiently large to allow movement of said plunger; and a link pivoted on said housing, pin-jointed to said plunger at a first end of said plunger by said coupling pin and coupled to a moving part at a second end of said plunger.

2. A remotely controlled relay comprising:

a housing;

means fixed to said housing for producing magnetic flux;

a plunger reciprocally driven by said magnetic flux in a direction vertical to said housing;

means for operating a switch, pivoted on said housing and having a first end coupled to said plunger with a coupling pin in a coupling hole and a second end contacting a switch in communication with a remote control circuit, a diameter of said coupling hole being larger than a diameter of said coupling pin to permit said plunger to move from a first stroke position to a second stroke position even if said operating means is at a neutral point; and means pivoted on said housing and coupled to said plunger with said coupling pin for transmitting movement of said plunger.

* * * * *